US006751999B2

(12) United States Patent
Kamano

(10) Patent No.: US 6,751,999 B2
(45) Date of Patent: Jun. 22, 2004

(54) METHOD AND APPARATUS FOR FORMING METALLIC MATERIALS

(75) Inventor: Toshihisa Kamano, Numazu (JP)

(73) Assignee: Toshiba Kikai Kabushiki Kaisha, Tokyo-To (JP)

( * ) Notice: Subject to any disclaimer, the term of this patent is extended or adjusted under 35 U.S.C. 154(b) by 0 days.

(21) Appl. No.: 10/253,778

(22) Filed: Sep. 25, 2002

(65) Prior Publication Data

US 2003/0056562 A1 Mar. 27, 2003

(30) Foreign Application Priority Data

Sep. 27, 2001 (JP) ..... 2001-295318

(51) Int. Cl.[7] ..... B21D 37/16

(52) U.S. Cl. ..... 72/342.7; 72/342.1; 72/342.4; 72/342.5

(58) Field of Search ..... 72/342.1–342.2, 72/342.3, 342.4, 342.5, 342.6, 342.7–342.8, 342.92, 342.94, 364; 219/411

(56) References Cited

U.S. PATENT DOCUMENTS 3,698,219 A * 10/1972 Moore et al. ..... 72/38
4,666,665 A * 5/1987 Hornsby et al. ..... 419/48
5,515,705 A * 5/1996 Weldon et al. ..... 72/19.1
6,437,292 B1 * 8/2002 Sikka et al. ..... 219/411

* cited by examiner

*Primary Examiner*—Ed Tolan
(74) *Attorney, Agent, or Firm*—Pillsbury Winthrop LLP

(57) ABSTRACT

A metallic material 27 is placed between an upper die 6 and a lower die 13. Inert gas is fed into the processing chamber 17 defined by a transparent quartz tube 16. The dies 6 and 13 are heated together with the metallic material 27 by infrared lamps 20. The dies 6 and 13 are closed to form the material 27.

6 Claims, 2 Drawing Sheets

METHOD AND APPARATUS FOR FORMING METALLIC MATERIALS

BACKGROUND OF THE INVENTION

1. Field of the Invention

The present invention relates to a method and an apparatus for forming metallic materials.

2. Description of the Related Art

Various methods of forging metallic materials at high temperatures have been known. In a typical hot-forging process, the metallic material is heated by a suitable method, such as induction-heating, is conveyed to the dies, and is forged by the dies. In this process, the temperatures of the metallic material and the dies are not controlled precisely, and the condition of the forged metallic material thus can not be controlled. Therefore, the forged material must be heat-treated to control the metallic structure and/or the mechanical properties of the material.

In addition, in the conventional hot-forging process, the atmosphere is not controlled. Thus, the surface of the forged material is oxidized, and must be descaled.

SUMMARY OF THE INVENTION

Accordingly, it is an object of the present invention to provide a method of forming a metallic material that enables precise temperature control of the metallic material.

The second object of the present invention is to provide a method of forming a metallic material that avoids formation of undesirable surface layer, such as oxidized layer.

The third object of the present invention is to provide an apparatus capable of executing the above methods.

To achieve the above objectives, the present invention provides a method of forming a metallic material, the method including the steps of: placing a metallic material between dies; heating the metallic material together with the dies; and forming the metallic material by using the dies.

Preferably, the heating step is carried out by irradiating thermal radiation to the metallic material and the dies, by means of a heater being arranged remote from the metallic material and the dies. In a specific embodiment, the heater comprises a plurality of infrared lamps.

Preferably, in the heating step and the forming step, an inert gas atmosphere is established around the metallic material and the dies.

Alternatively, an evacuated atmosphere may be established instead of the inert gas atmosphere.

The method may further include the step of: cooling, after the forming step, the metallic material and the dies by using the inert gas; and removing, after the cooling step, the metallic material from the dies. In the cooling step, the inert gas atmosphere or the evacuated atmosphere is preferably maintained.

The present invention also provides a forming apparatus, which includes: first and second die supports each adapted to retain a die for forming a metallic material; a drive that causes relative movement between the die supports to form the metallic material; and a heater adapted to heat the dies together with the metallic material.

In one embodiment, the above heater is configured to irradiate thermal radiation and is arranged remote from the metallic material and the dies. In a specific embodiment, the heater comprises a plurality of infrared lamps arranged around the metallic material and the dies.

In a specific embodiment, the apparatus is provided with an enclosure adapted to surround the dies to form a forming chamber in which the metallic material is formed. The enclosure is transmissive to the thermal radiation.

The apparatus is preferably provided with an inert gas feeder that supplies an inert gas into the processing chamber. In a specific embodiment, the die support is provided with a gas passage, through which the inert gas is fed to the dies.

DESCRIPTION OF THE PREFERRED EMBODIMENTS

Figure 1:
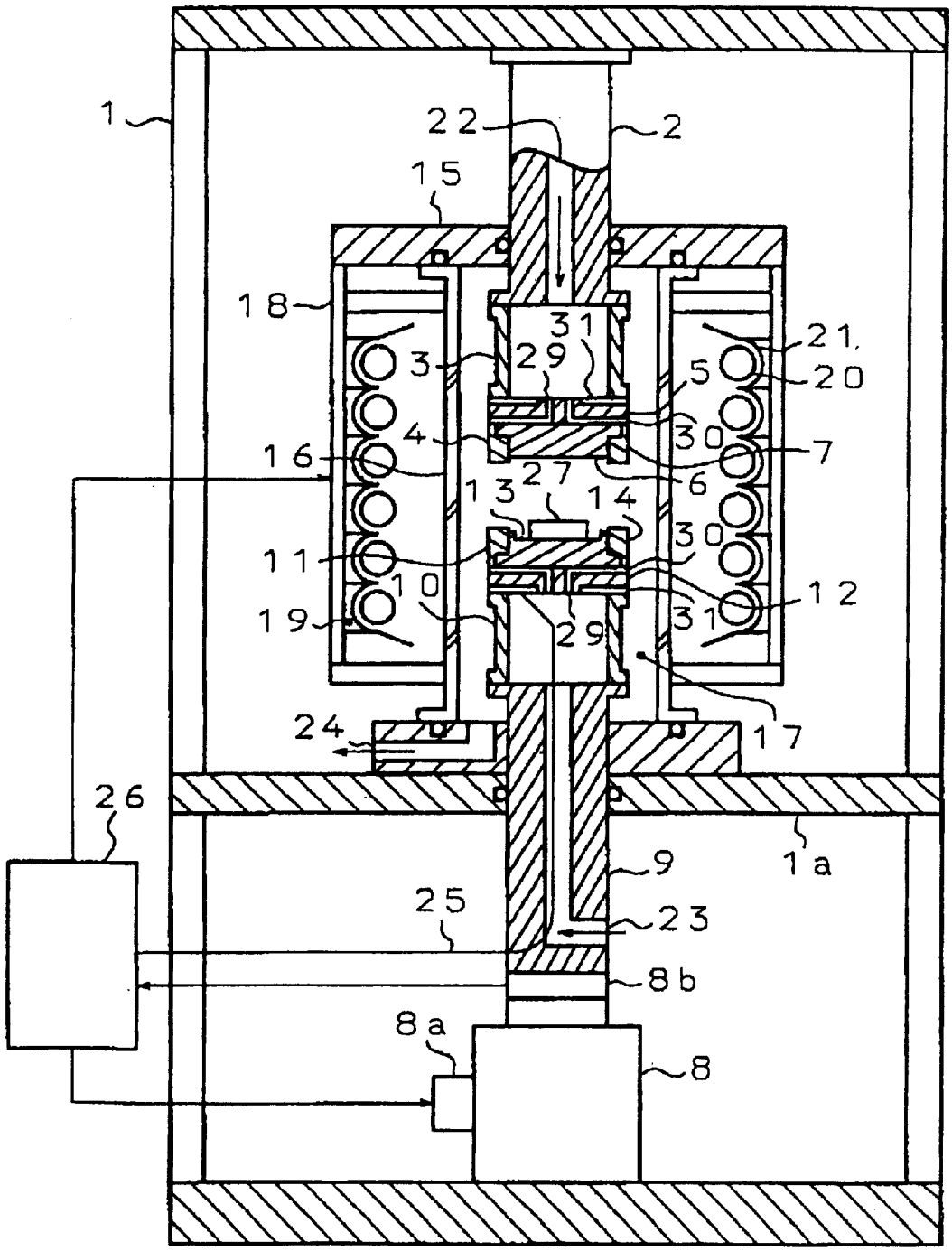
FIG. 1 is a cross-sectional view of the forming apparatus according to the present invention.
Figure 2:
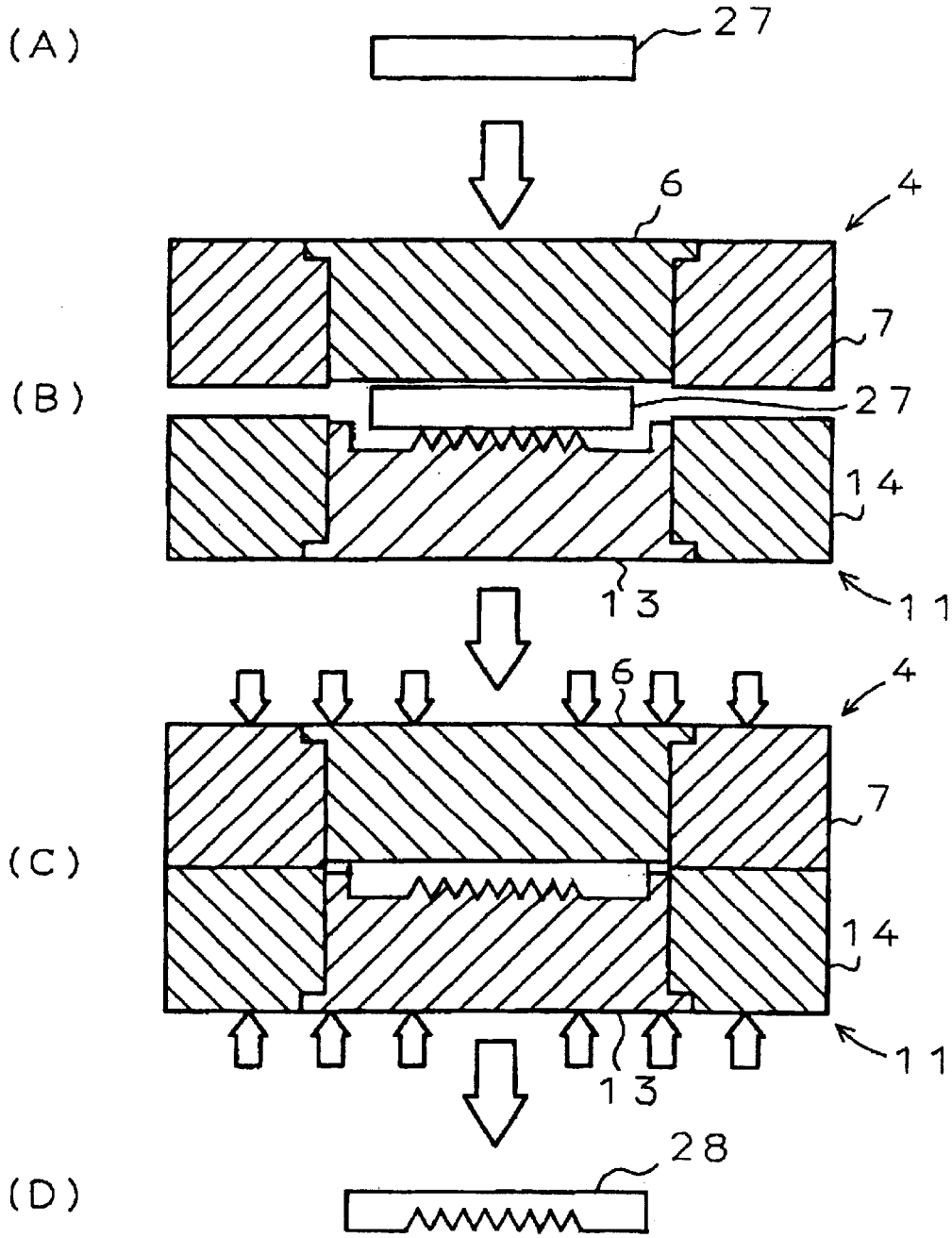
FIG. 2 shows forming process according to the present invention.

With reference to FIGS. 1 and 2, a preferred embodiment of a metallic-material forming apparatus according to the present invention will be described. The forming apparatus has a frame 1. A stationary shaft 2 extends downward from an upper beam of the frame 1. An upper die assembly 4 is fixed to the lower end of the shaft 2 via a heat insulating tube 3, by using fastening means, such as bolts.

The upper die assembly 4 comprises a die plate 5 made of a metallic material, an upper die 6 made of a hard metal (cemented carbide) or a ceramic material, and a stationary die 7. The stationary die 7 functions not only as a die but also as a fastening member that fixes the upper die 6 to the die plate 5.

Provided on a bottom of the frame 1 is a drive 8, which includes a servomotor 8*a* and a screw jack (not shown) converting rotational movement of the servomotor 8*a* into linear movement. A movable shaft 9 is attached to the drive 8 via a load cell 8*b*. The movable shaft 9 extends upward and aligned with the stationary shaft 2. By moving the servomotor 8*a*, the movable shaft 9 moves vertically. The position and the moving speed of the movable shaft 9 are controlled by a controller 26, in which a control program is stored. The pressure acting on the metallic material 27, which corresponds to the torque of the servomotor 8*a*, is also controlled by the controller 26.

A lower die assembly 11 is attached to the upper end of the movable shaft 9 via a heat insulating tube 10, which is similar to the heat insulating tube 3. The lower die assembly 11 is similar to the upper die assembly 4, and thus comprises a die plate 12, a lower die 13 and a movable die 14.

A bracket 15 is attached to the stationary shaft 2. The bracket 15 is capable of vertical movement relative to the stationary shaft 2 via a driving device (not shown). Attached to the bracket 15 is a transparent quartz tube 16, which surrounds the upper and lower die assemblies 4 and 11. The bottom end of the quartz tube 16 sealingly contacts to a middle plate 1*a* to form a forming chamber 17, which is separated from the atmosphere of the exterior of the chamber 17.

Attached to the bracket 15 is an outer tube 18, which surrounds the quartz tube 16. A lamp unit 19 is mounted on an inner surface of the outer tube 18. The lamp unit 19 includes infrared lamps 20, reflectors (mirror) 21 and water pipes (not shown) for cooling the reflectors 21. The lamp unit 19 is capable of heating the metallic material 27 together with the upper and lower die assemblies 4 and 11.

Gas passages 22 and 23 are formed in the stationary and movable shafts 2 and 9, respectively. The passages 22 and 23 are connected to communication holes 29 and slits 30 and 31 formed in the die plates 5 and 12, respectively. Inert gas fed to the gas passages 22 and 23 is introduced into the forming chamber 17 via the holes 29 and the slits 30 and 31. The flow rate of the inert gas fed to the gas passages 22 and 23 is controlled by a flow-controller (not shown). Each of the upper and lower dies 6 and 13 are coated with a coating (not shown) in order to prevent the metallic material 27 from adhering on the surfaces of the dies. The inert gas prevents oxidation of the metallic material 27, the coatings of the dies, the die plates 5 and 12, and the stationary and movable dies 7 and 14. The inert gas also cools the upper and lower die assemblies 4 and 11. The inert gas fed into the forming chamber 17 is discharged from an exhaust port 24.

A thermocouple 25 is attached to the lower die assembly 11. The thermocouple 25 may be attached to the lower die 13 in order to detecting the temperature of the lower die 13 directly. The thermocouple 25 may also be attached to the upper die assembly 4.

The forming process employing the above-described apparatus will be described with reference to FIGS. 1 and 2.

As shown in FIG. 2(A), a metallic material 27 is prepared. The metallic material 27 has been preformed in a suitable shape by a well-known process, such as forging and/or machining, before subjected to the forming process according to the present invention. Preferably, the metallic material 27 has the same weight and/or volume as that of the final product. It is also preferable that the shape of the metallic material 27 is similar to that of the final product.

The metallic material 27 is placed between the upper die 6 of the upper die assembly 4 and the lower die 13 of the lower die assembly 11. In a specific embodiment, the material 27 is placed on the lower die 13, as shown in FIG. 2(B).

Inert gas is introduced into the forming chamber 17 so that the inert gas atmosphere is established in the forming chamber 17. Then, the upper and lower die assemblies 4 and 11 and the metallic material 27 placed therebetween are concurrently heated by the lamp unit 19.

The temperature of the lower die assembly 11 is detected to the thermocouple 25. The controller 26 estimates the temperature of the metallic material 27 based on the detected temperature of the lower die assembly 11. To this end, an experimentally-obtained formula, which represents the relation between the temperatures of the metallic material 27 and the lower die assembly 11, is included in the control program stored in the controller 26.

When the metallic material 27 is heated up to a designated temperature, at which the metallic material 27 is softened and can be formed into desireble shape by relatively low pressing force, the lower die assembly 11 is raised to press the metallic material 27 by the upper and lower dies 6 and 13, as shown in FIG. 2(C). During the above operation, the moving speed, the position and the pressing force of the lower die 13 are controlled by the control program stored in the controller 26, thereby achieving a precise forming of the metallic material.

Then, the infrared lamps 20 are turned off, and the upper and lower die assemblies 4 and 11 and metallic materials 27 are cooled by the inert gas flowing through the gas passages 22, 23, the communication holes 29 and the slits 30 and 31. Then, the lower die assembly 11 is lowered, and the metallic material 27 formed in a shape as shown in FIG. 2(D) is removed from the upper and lower dies 6 and 13. According to the above process steps, the metallic material 27 has become a final product.

Preferably, during the cooling process, the lower die 13 is continuously pressed against the upper die 6 by the time when the temperature of the metallic material 27 is lowered to a sufficiently low temperature, such as room temperature. Thereby, desireble shape and dimensions of the final product can be achieved. If the metallic material 27 is removed from the upper and lower dies 6 and 13 before the temperature of the metallic material 27 reaches to a sufficiently low temperature, an undesirable deformation of the metallic material 27 may occur when the metallic material 27 is cooled.

According to the above embodiment, since the metallic material 27 and the dies 6 and 13 are accommodated in the forming chamber 17 and are heated concurrently, the temperature of the metallic material 27 and dies 6 and 13 can be controlled precisely. In addition, since the atmosphere of the forming chamber 17 is controlled, formation of undesirable surface layers, such as an oxidized layer can be prevented.

In the foregoing embodiment, the heating step, the forming step and the cooling step are carried out at an inert gas atmosphere. However, these process steps may be carried out at an evacuated atmosphere.

The material to be formed may be various kinds of metallic materials, such as aluminum, copper and gold.

What is claimed is:

1. A method of forming a metallic material comprising:

placing a metallic material between dies;

covering the metallic material and the dies with a transparent enclosure to define a sealed space accommodating the metallic material and the dies;

heating the metallic material together with the dies with an infrared lamp arranged outside the transparent enclosure; and forming the metallic material by using the dies.

2. The method according to claim 1, wherein, in the heating and the forming, an inert gas atmosphere is established around the metallic material and the dies.

3. The method according to claim 2, further comprising:

cooling, after the forming, the metallic material and the dies by using the inert gas; and removing, after the cooling, the metallic material from the dies.

4. A forming apparatus comprising:

first and second die supports, each adapted to retain a die for forming a metallic material;

a drive arranged to cause relative movement between the die supports to form the metallic material;

an infrared lamp adapted to heat the dies together with the metallic material; and a transparent tube adapted to define therein a sealed space that accommodates the die supports with the infrared lamp being located outside the transparent tube, whereby the dies retained by the die supports and the metallic material located between the dies are collectively heated by infrared light emitted by the infrared lamp and transmitted through the transparent tube.

5. The apparatus according to claim 4, further comprising an inert gas feeder configured to supply an inert gas into the sealed space.

6. The apparatus according to claim 5, wherein each of the die supports is provided with a gas passage, through which the inert gas is fed to the die.

* * * * *